US006390101B1

(12) United States Patent
Alexander

(10) Patent No.: US 6,390,101 B1
(45) Date of Patent: May 21, 2002

(54) SELF-CONTAINED APPLICATOR FOR APPLYING FLUID

(76) Inventor: Larry Rush Alexander, 2306 Central St., Evanston, IL (US) 60201

( * ) Notice: Subject to any disclaimer, the term of this patent is extended or adjusted under 35 U.S.C. 154(b) by 0 days.

(21) Appl. No.: 09/566,538

(22) Filed: May 8, 2000

(51) Int. Cl.[7] ..... A45D 24/22

(52) U.S. Cl. ..... 132/116; 132/112; 132/115

(58) Field of Search ..... 132/116, 112, 132/111, 113, 114, 115, 109, 110, 124; 401/284, 195, 37

(56) References Cited

U.S. PATENT DOCUMENTS

| | | | | | |
|---|---|---|---|---|---|
| 203,256 | A | * | 5/1878 | Frobisher | 132/112 |
| 1,629,389 | A | * | 5/1927 | Johnson | 132/112 |
| 2,249,267 | A | * | 7/1941 | Berry | 132/124 |
| 2,249,401 | A | * | 7/1941 | Sieg | 132/124 |
| 2,288,156 | A | * | 6/1942 | Dove | 132/124 |
| 2,723,411 | A | * | 11/1955 | Ellis | 132/124 |
| 3,410,283 | A | * | 11/1968 | Goldberg | 132/124 |
| 4,209,027 | A | | 6/1980 | Morganroth | 132/9 |
| 4,354,512 | A | | 10/1982 | Roppatte, Jr. | 132/112 |
| 4,783,186 | A | | 11/1988 | Manning et al. | 401/190 |
| 5,000,199 | A | | 3/1991 | Kuranski et al. | 132/112 |
| 5,035,251 | A | | 7/1991 | Hollenberg et al. | 132/112 |
| 5,152,305 | A | * | 10/1992 | Niv | 132/112 |
| 5,289,835 | A | * | 3/1994 | Harlan et al. | 132/313 |
| 5,333,627 | A | * | 8/1994 | Mehringer et al. | 132/108 |
| 5,361,941 | A | | 11/1994 | Parekh et al. | 222/95 |
| 5,555,899 | A | | 9/1996 | Foreman | 132/114 |
| 5,755,241 | A | | 5/1998 | Cheung | 132/112 |
| 5,772,077 | A | | 6/1998 | Tafur | 222/192 |
| 5,848,598 | A | | 12/1998 | Walz et al. | 132/112 |
| 5,913,314 | A | * | 6/1999 | Garrett | 132/112 |
| 5,915,390 | A | * | 6/1999 | Daughtry | 132/112 |
| 5,937,865 | A | * | 8/1999 | Dhaliwal | 132/114 |
| 5,951,185 | A | * | 9/1999 | Kingsford et al. | 401/99 |
| 6,022,163 | A | * | 2/2000 | Asfur | 401/175 |

* cited by examiner

*Primary Examiner*—John J. Wilson
*Assistant Examiner*—Robyn Kieu Doan
(74) *Attorney, Agent, or Firm*—McAndrews, Held & Malloy, Ltd.

(57) ABSTRACT

An apparatus for applying a fluid to hair is provided. The apparatus includes a reservoir for containing a fluid, sidewalls for defining the reservoir. The sidewalls form an elongate curvilinear cavity along an interior surface and forming an exterior surface, wherein the cavity includes the reservoir and having a top portion and a bottom portion and the cavity having a longitudinal axis. The applicator also includes a top endwall located at the top portion of the sidewalls and the endwall includes an elongate cavity for dispensing a fluid. A flexible lip is located adjacent the cavity for assistance in dispensing a fluid from the elongate cavity is also included in the applicator. The applicator includes a movable bottom endwall for containing the fluid within the reservoir and advancing fluid and a rotatable smoothing rod attached to the exterior surface of the sidewalls.

17 Claims, 4 Drawing Sheets

SELF-CONTAINED APPLICATOR FOR APPLYING FLUID

CROSS REFERENCE TO RELATED APPLICATIONS

Not applicable.

STATEMENT REGARDING FEDERALLY SPONSORED RESEARCH & DEVELOPMENT

Not applicable.

BACKGROUND OF THE INVENTION

The present invention relates to devices for applying a fluid, and in particular to devices for applying fluid to hair.

In the past, there has been a great need applicators for applying fluid to hair. For example, many people desire to have their hair straightened. One fluid used for straightening hair is Sodium Hydroxide, or lye. When applying hair straightening fluids (commonly called "relaxers") to the hair, the hairdresser applies relaxer one section of the hair at a time and uses his fingers or the backside of a brush to smooth the hair. Due to the chemicals in the relaxer and the smoothing technique, the hair thus becomes straightened. This procedure is desirable for people with curly hair who wish to have straight hair. The procedure is particularly desirable for people with ethnic or racial backgrounds having very curly hair, for example African-Americans.

While other applicators exist, there exists a need for a self-contained applicator with a well-controlled dispensing slot and an apparatus for smoothing integral with the applicator. Moreover, it is desirable to have an applicator that has the capability of being connected to several different sizes of combs (for varying thicknesses of hair). For example, different types of hair have varying thicknesses of hair, such as round-celled hair (straight), oval shaped hair (wavy) and flat cell hair (curly). Different combs are desirable to be used with these varied thicknesses.

BRIEF SUMMARY OF THE INVENTION

It is an object of the present invention to provide an improved applicator for applying relaxer or other fluids to hair.

It is another objection of the invention to provide a self-contained applicator.

It is a further object of the invention to provide an applicator capable of both applying and smoothing a fluid onto hair.

In one embodiment, the apparatus includes a reservoir for containing a fluid, sidewalls defining the reservoir, the sidewalls forming an elongate curvilinear cavity along an interior surface and forming an exterior surface. The cavity includes the reservoir and has a top portion and a bottom portion and the cavity also has a longitudinal axis. The applicator also includes a top endwall located at the top portion of the sidewalls, wherein the endwall includes an elongate cavity for dispensing a fluid. A flexible lip is located adjacent the cavity for assistance in dispensing a fluid from the elongate cavity is also included in the applicator. The applicator also includes a movable bottom endwvall for containing the fluid within the reservoir and advancing fluid and a rotatable smoothing rod attached to the exterior surface of the sidewalls.

DETAILED DESCRIPTION OF THE PREFERRED EMBODIMENT

Figure 1:
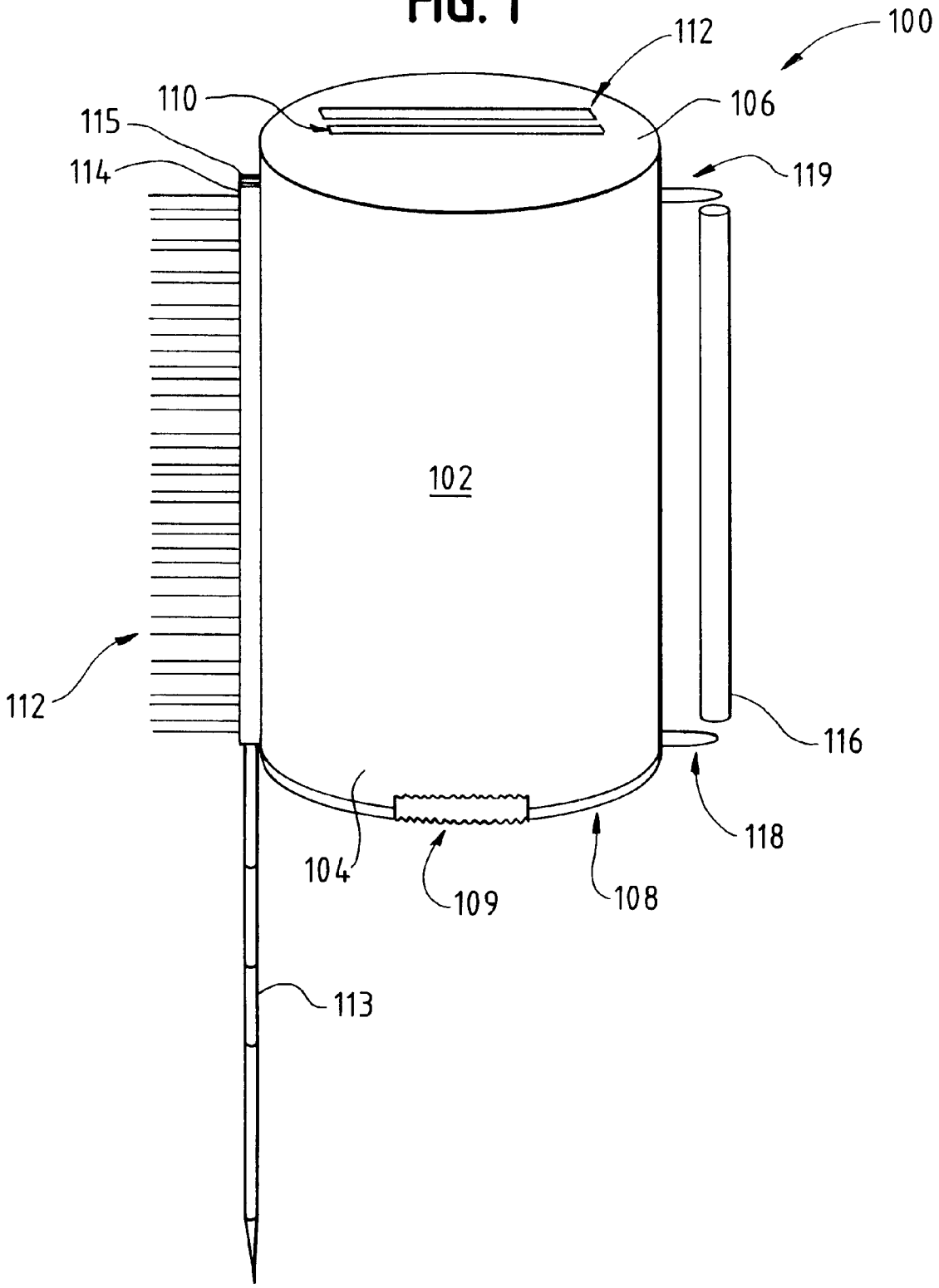
FIG. 1 is a side view of an applicator according to a particular embodiment of the invention.

Referring to FIG. 1, the preferred applicator 100 is shown. The applicator 100 includes a body 102 having sidewalls 104, a dispensing end 106 and a non-dispensing end 108. A driver 109 is located adjacent the non-dispensing end 108. The top surface 106 includes an elongated slot out 110 and a lip 112 adjacent the slot 110, protruding from the dispensing end 106. The applicator 100 also includes a comb or brush 112 having a rattail 113. The comb 112 is secured to the applicator 100 by two retaining tracks 114, 115. The preferred applicator further includes a roller 116 attached to the applicator using two similarly constructed supports 118.

In the preferred embodiment of FIG. 1, the sidewalls 102 form an elongate curvilinear-shaped object with an oval cross-section. In this illustrated embodiment, the sidewalls 102 actually form one continuous wall extending the perimeter of the applicator. The interior of the applicator 100, and thus inside the sidewalls 102, contains the fluid sought to be dispensed from the slot 110. Attached to the sidewall 102 of the preferred applicator 100 are two supports 118, 119 for securing a smoothing rod 116 to the applicator 100. The function of the smoothing rod 116 will be further discussed below. Attached to the other side of the sidewall 102 in the preferred embodiment are vertically aligned tracks 114, 115 for securing a comb or brush 112 to the applicator 100. The location of the tracks 114, 115 is preferably opposite the supports 118, 119 and smoothing rod 116 in order to allow free movement of the rod 116 and freedom to use the comb 112 without interference. A lip 112 is preferably attached to the top surface 106 of the applicator 100. The lip 112 is located adjacent the dispensing slot 110 for reasons that will be further discussed below.

The dispensing slot 110 is elongated so as to permit the fluid retained within the applicator 100 to be dispensed in a wide path. The lip 112 then assists in spreading the fluid dispensed from the slot 110 uniformly. For example, as fluid is forced out of the slot 110, as will be further discussed below, the fluid advances onto the lip 112 and is ideally spread evenly across the hair across which the lip 112 and slot 110 move. In alternative embodiments shown in FIGS. 3*a* and 3*b*, brush bristles 302 or teeth 304 may alternatively be attached adjacent the dispensing slot 110. Bristles 302 may be particularly desirable if bleach or hair color is being applied and teeth 304 may be desirable for use with hair gel. In any event, the slot 110 and structure for assisting in applying the fluid to the hair is preferably located on the dispensing end 106 (which is preferably part of a removable cap), rather than the sidewalls 102. Having this structure on the dispensing end permits the applicator 100 to be used with multiple endcaps, each containing the different structure, such that one applicator may be used for applying several different fluids.

The dispensing end 106 is preferably convex in shape so that the dispensing slot 110 is centrally located at the highest spot on the end 106 and the lip 112 is adjacent the slot. The convex shape assists the user in applying the fluid, for example relaxer, to the head because it permits the user to place the curved end 106 onto the hair, allowing a slight separation of the slot 110 from the scalp. The separation is desirable because of the damage relaxer can do if placed directly onto the scalp. In an alternative embodiment, the applicator 100 includes two nobs 306, which are raised with respect to the dispensing end 106 (as shown in FIG. 3*a*), to achieve separation between the slot 110 and the hair.

The rod 116 is secured to the applicator 100 by supports 118, 119 and preferably extends vertically along the sidewall 102. The rod 116 is secured by the supports 118, 119 such that it is free to spin about its axis. As a result, the user may roll the smoothing rod along the hair after the fluid has been applied to the hair. When straightening hair for example this has the desired result of permitting the scalp to be used as the "ironing board" for the hair to be pressed against. This is a significant improvement over the present method in which the user straightens or flattens the hair using his or her thumbs or the backside of a brush.

Another desired feature of the applicator 100 is the telescoping rattail, or parting wand, 113 extending from the comb 112 or non-dispensing end 108 of the applicator 100. The rattail or parting wand 113 is used to part hair, for example to separate different sections of hair for relaxer to be applied to the separate portions. The telescoping feature permits the wand 113 to be placed out of the way when a fluid, such as relaxer, is being applied to the hair, and to be extended only when needed. The telescoping feature also permits the wand to be extended to differing lengths, thereby adapting to the user's preference.

Figure 2:
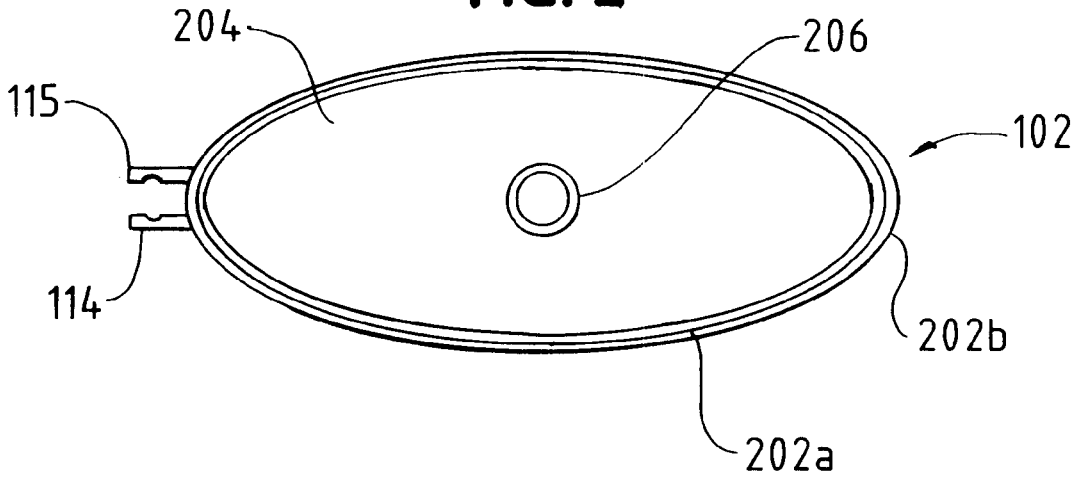
FIG. 2 is top view of a cross-section of an applicator according to a particular embodiment of the present invention.

Turning now to FIG. 2, that Figure provides a look at a cross-section of the sidewalls 102. The sidewalls 102 have an interior surface 202*a* and an exterior surface 202*b*. A movable endwall 204 and a driving shaft 206 are also shown in FIG. 2. The movable endwall 204 and interior surface 202*a* of the sidewalls 102 forms a reservoir for containing a fluid, such as relaxer, within the applicator 100. When more fluid is desired to be pushed from the slot 110, the user may turn the driver 109, which turns the driving shaft 206. The driving shaft 206 is threaded like a screw and drives the movable endwall 204 up and down as the driver 109 is turned. When the driver 109 is turned, the movable endwall 204 thus decreases the size of the reservoir and forces fluid toward the dispensing end 106 and out through the slot 110, preferably onto the subject's hair. While the driver 109 and driving shaft 206 combination is the preferred structure for advancing fluid to and out of the dispensing slot 110, other methods for advancing the fluid may be used. For example, the movable wall 204 may be secured within the inner surface 202*a* using a friction fit or other method. The applicator 100 may also use a pushable button or device, for advancing a movable wall, which is located on the sidewall 102. This arrangement may permit the user to more easily dispense fluid while he or she is applying the fluid. Ultimately, it is desired that the dispensing end 106 include a removable cover to permit replacement of fluid within the applicator 100 when the applicator 100 is empty or low on fluid.

Figure 3:
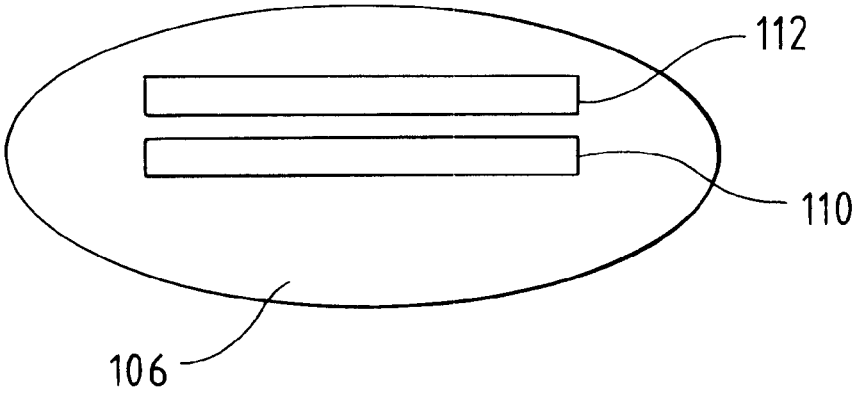
FIG. 3 is a top view of a dispensing end of the applicator according to three alternative embodiments of the invention.
Figure 3A:
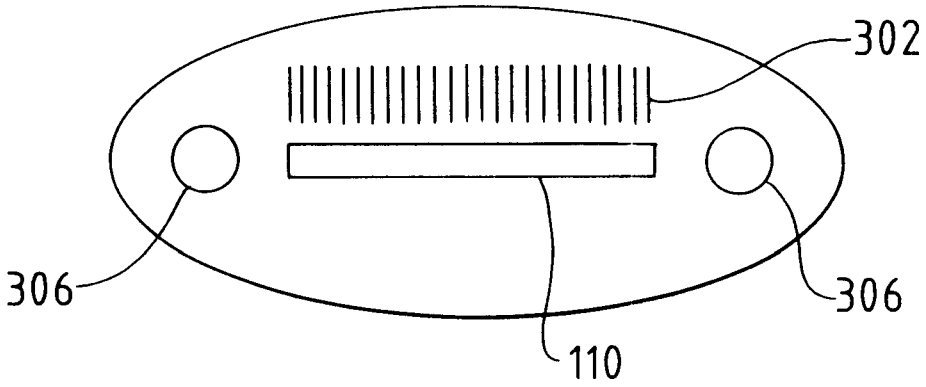
Figure 3B:
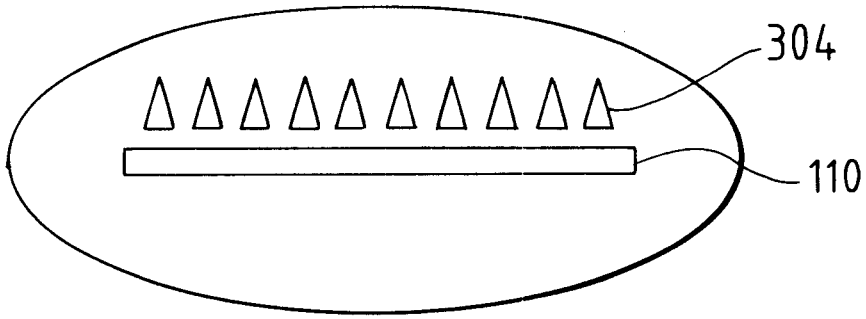
Figure 4:
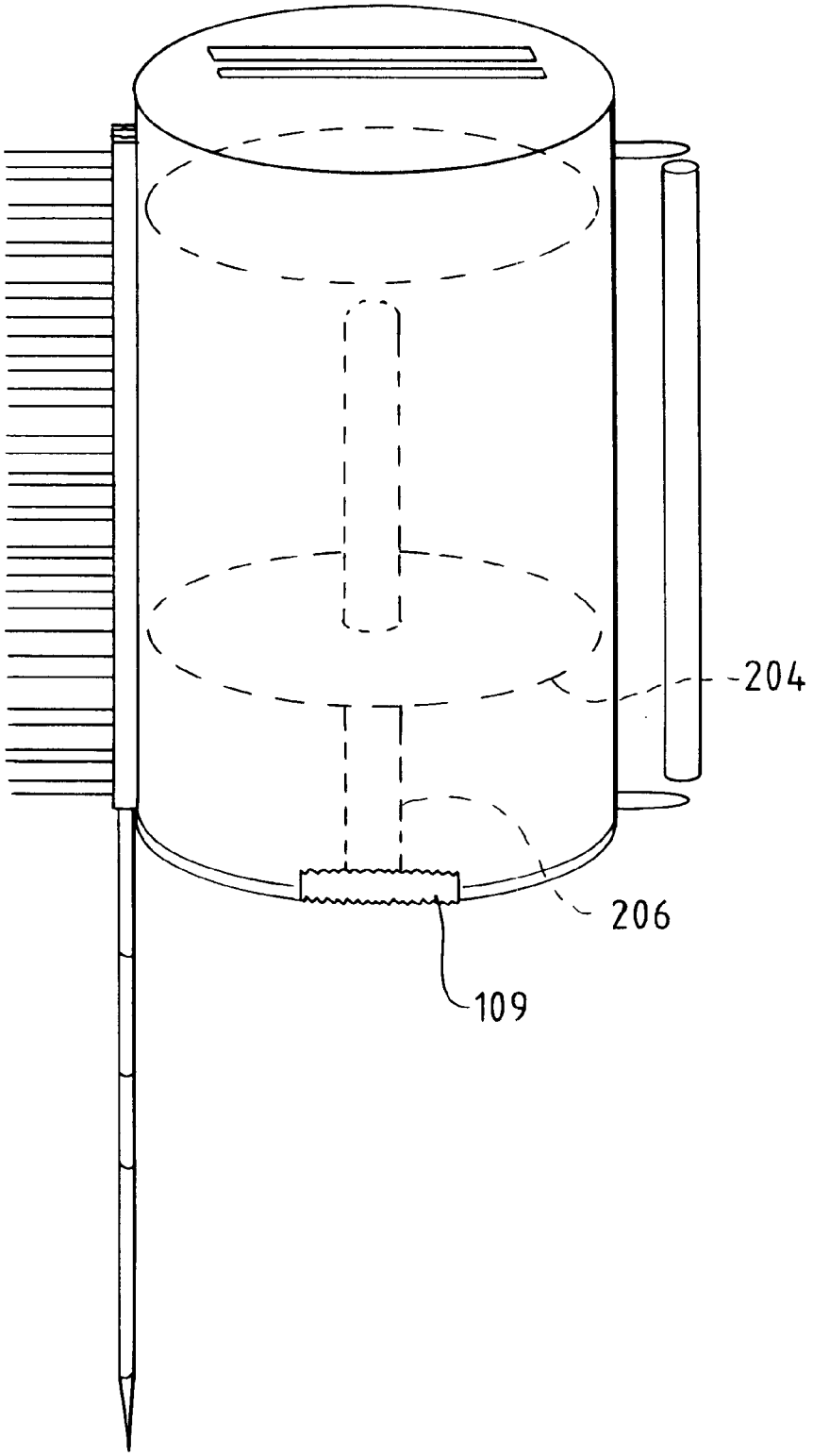
FIG. 4 is a partially exposed side view of an applicator according to a particular embodiment of the invention.

Turning now to FIGS. 3 and 4, FIG. 3 presents a top view of the dispensing end 106, including the elongated dispensing slot 110 and the lip 112. FIG. 4 illustrates the interior of the preferred applicator, including the driver 109, shaft 206 and movable endwall 204. The fluid fills the interior cavity of the applicator 100 and the top surface is shown near the dispensing end 106.

During use, the applicator 100 is preferably tipped upside down, causing the fluid sought to be dispensed onto the hair. After the fluid is placed on the hair, the user may tip the applicator 100 on its side and use the smoothing rod 116 to smooth, spread or apply the fluid evenly (if desired) onto the hair. As a result, depending on how the user holds the applicator 100, he or she may wish to detach the comb 112, collapse the wand 113, or not even have the tracks 114, 115 present on the applicator 100 for easy holding of the applicator 100. Moreover, the fluid is preferably viscous enough such that it does not automatically exit the slot 110 when the applicator 100 is held sideways (so the smoothing rod 116 may be effectively used), but rather is dispensed by the user causing the movable wall 204 to be moved. As a result, depending on the substance the applicator is being used with, the slot may be of a width to prevent dispensation of the fluid without the user causing the endwall 204 to move. In an alternative embodiment, the slot is equipped with a structure (not shown) for varying the width of the slot so that different fluids can be accommodated within the same applicator 100 for different applications. The dispensing end 106 is preferably removable to allow the user to fill the applicator 100 with the desired fluid.

While particular embodiments of the invention have been shown, it will be understood, of course that the invention is not limited thereto since modifications may be made by those skilled in the art, particularly in light of the foregoing teachings. For example, although a preferred use of the applicator 100 is to apply relaxer to hair, the applicator 100 may also be used for dispensing other substances, for example gel, leave-in conditioner, hair color or bleach to the hair. Additionally, an alternative embodiment includes the elongated slot 110 as a slot in the sidewall 102, adjacent the dispensing end 106 of the applicator. It is, therefore, contemplated by the appended claims to cover any such modifications as incorporate those features which constitute the essential features of these improvements within the true spirit and the scope of the invention.

What is claimed is:

1. An apparatus for applying a fluid to hair comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis;

a top endwall located at said top portion of said sidewalls, said endwall comprising an elongate cavity for dispensing a fluid;

a movable bottom endwall for containing said fluid within said reservoir and advancing fluid; and a rotatable smoothing rod attached to the exterior surface of said sidewalls.

2. The apparatus of claim 1 further comprising a flexible lip adjacent said cavity for assistance in dispensing a fluid from said elongate cavity.

3. The apparatus of claim 1 wherein said sidewalls form an elongate curvilinear cavity having an oval cross-section.

4. The apparatus of claim 1 wherein smoothing rod has a longitudinal axis, said rod axis being substantially parallel to the longitudinal axis of said cavity and further comprising retaining tracks disposed to removably secure a comb to the exterior surface of said sidewalls.

5. The apparatus of claim 4 wherein said tracks are disposed parallel said longitudinal axis of said cavity.

6. The apparatus of claim 1 further comprising an elongate parting device telescopically extendable from said apparatus for parting hair.

7. The apparatus of claim 6 wherein said elongate parting device is telescopically extendable from said bottom portion of said sidewalls.

8. The apparatus of claim 1 wherein said rotatable smoothing rod has a relatively high friction surface.

9. The apparatus of claim 8 wherein said smoothing rod is made of a rubber-like thermoplastic material.

10. An apparatus for dispensing a fluid comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis, said sidewalls comprising a dispensing slot for dispensing a fluid disposed at said top portion of said sidewalls;

a top endwall located at said top portion of said sidewalls;

a flexible lip adjacent said cavity for assistance in applying a fluid dispensing from said elongate cavity to hair;

a bottom endwall for containing said fluid within said reservoir fluid; and a rotatable smoothing rod attached to the exterior surface of said sidewalls.

11. An apparatus for applying a fluid to hair comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis;

a top endwall located at said top portion of said sidewalls, said endwall comprising an elongate cavity for dispensing a fluid;

a movable bottom endwall for containing said fluid within said reservoir and advancing fluid;

structure adjacent said cavity for assistance in applying a fluid dispensing from said elongate cavity to hair; and an elongate parting device telescopically extendable from said apparatus for parting hair.

12. The apparatus of claim 11 wherein said structure adjacent said cavity comprises bristles.

13. The apparatus of claim 11 wherein said structure adjacent said cavity comprises teeth.

14. The apparatus of claim 11 wherein said elongate parting device is telescopically extendable from said bottom portion of said sidewalls.

15. The apparatus of claim 11 wherein said structure adjacent said cavity comprises a flexible lip.

16. An apparatus for applying a fluid to hair comprising:

a reservoir for containing a fluid;

sidewalls defining said reservoir, said sidewalls forming an elongate curvilinear cavity along an interior surface and forming an exterior surface, said cavity comprising said reservoir, said sidewalls having a top portion and a bottom portion and said cavity having a longitudinal axis;

a top endwall located at said top portion of said sidewalls, said endwall comprising an elongate cavity for dispensing a fluid;

a movable bottom endwall for containing said fluid within said reservoir and advancing fluid;

structure adjacent said cavity for assistance in applying a fluid dispensing from said elongate cavity to hair; and at least one extension attached to said top endwall to achieve separation between the elongate cavity and scalp under the hair to which the fluid is being applied.

17. The applicator of claim 16 wherein said at least one extension comprises a plurality of nubs and said elongate cavity has first and second opposing ends, wherein at least one of said nubs is positioned on the first end of said cavity and at least one of said nubs is positioned on the second end of said cavity.

* * * * *